US006502256B1

(12) United States Patent
McNeil et al.

(10) Patent No.: US 6,502,256 B1
(45) Date of Patent: Jan. 7, 2003

(54) DRAWER WITHOUT HARDWARE FOR INSTALLATION UNDER BED

(76) Inventors: John McNeil, 337 Pleasant St., Petaluma, CA (US) 94952; James B. Hickman, 860 Falcon Way, Healdsburg, CA (US) 95448; Michael W. Isheim, 338 Sequoia Ter., Danville, CA (US) 94506

( * ) Notice: Subject to any disclaimer, the term of this patent is extended or adjusted under 35 U.S.C. 154(b) by 0 days.

(21) Appl. No.: 09/773,714

(22) Filed: Jan. 31, 2001

Related U.S. Application Data

(60) Provisional application No. 60/179,307, filed on Jan. 31, 2000.

(51) Int. Cl.[7] ..... A47B 19/22

(52) U.S. Cl. ..... 5/308; 5/58; 5/201; 312/319.1

(58) Field of Search ..... 5/201, 202, 207, 5/208, 308, 58; 312/319.1

(56) References Cited

U.S. PATENT DOCUMENTS

| | | | | | |
|---|---|---|---|---|---|
| 1,450,974 | A | * | 4/1923 | Heotes | 312/204 |
| 1,714,200 | A | | 5/1929 | Wells | |
| 1,758,718 | A | * | 5/1930 | Robinson | 5/193 |
| 1,849,809 | A | * | 3/1932 | Showers | 312/319.1 |
| 1,866,953 | A | * | 7/1932 | Stephens | 5/308 |
| 2,290,615 | A | * | 7/1942 | Firestone | 232/41 R |
| 2,483,938 | A | * | 10/1949 | Royston | 5/2.1 |
| 2,701,884 | A | | 2/1955 | Young | |
| 3,745,596 | A | | 7/1973 | Copeland | |
| 4,196,484 | A | | 4/1980 | Harris | |
| 4,458,371 | A | | 7/1984 | Whitehead | |
| 4,554,692 | A | | 11/1985 | Whitehead | |
| 4,597,117 | A | * | 7/1986 | Sumner | 5/181 |
| 4,613,999 | A | * | 9/1986 | Franco et al. | 312/140 |
| 4,617,689 | A | | 10/1986 | Nelson et al. | |
| 4,675,929 | A | | 6/1987 | Santo | |
| 4,888,838 | A | * | 12/1989 | Pelski | 5/207 |
| 5,004,306 | A | * | 4/1991 | Oshida | 312/319.1 |
| 5,012,538 | A | | 5/1991 | Timm | |
| 5,070,556 | A | | 12/1991 | Gloger | |
| 5,099,529 | A | * | 3/1992 | Anderson | 5/201 |
| 5,135,294 | A | * | 8/1992 | Ohshima et al. | 312/319.1 |
| 5,549,375 | A | * | 8/1996 | Pagliaccio | 312/223.2 |
| 5,718,495 | A | * | 2/1998 | Lee | 297/423.41 |

FOREIGN PATENT DOCUMENTS

| | | | | |
|---|---|---|---|---|
| GB | 8303 | * | 10/1907 | 5/207 |
| GB | 153699 | * | 2/1920 | 5/308 |

* cited by examiner

*Primary Examiner*—Michael F. Trettel
(74) *Attorney, Agent, or Firm*—William Michael Hynes; Townsend and Townsend and Crew, LLP

(57) ABSTRACT

A prior art single stock keeping unit for accommodating double, queen, and king sized beds with both support and under the bed drawers is equipped with foot actuated drawer opening. Each stock keeping unit includes faced box spring supporting paired face frame-less cabinets which are conveniently shipped stacked one upon another and are placed back to back when assembled for underlying box spring support. Each face frame-less cabinet includes two floor-contacting members, two box spring contacting members, and three vertical members including a head vertical member, a foot vertical member, and an intermediate vertical member. Conventional drawers on side mounted drawer roller bearing and slide guides to expose a finished drawer front without hardware for opening and closing. The floor contacting member adjacent the drawer front is recessed relative to the drawer front to permit relatively small retracting movement of the drawer on side mounted drawer roller bearing and slide guides, the slide having a recessed portion for holding the drawer in the closed position. A detent-actuated spring is mounted between the drawer back and frame from which the drawer is supported. When the drawer is initially closed, the detent retracts and the side mounted drawer roller bearing and slide guides move to a recessed portion of the slides, maintaining the drawer closed. When opening is desired, further inward pushing against the detent mechanism causes detent expansion, the drawer supporting rollers are urged out of engagement to the slide recess, and opening occurs. An under bed mounted drawer is disclosed which may be easily opened from the reclining, sitting, and/or standing position.

2 Claims, 3 Drawing Sheets

DRAWER WITHOUT HARDWARE FOR INSTALLATION UNDER BED

PRIORITY

This Application claims priority from US Provisional Patent Application 60/179,307 filed Jan. 31, 2000 entitled Drawer Without Hardware for Installation Under Bed by the named inventors herein.

This invention relates to a mattress supporting cabinet for supporting both conventional and "soft sided" bedding. The disclosed mattress supporting cabinet has integral and recessed drawers which in the absence of hardware can be opened by pressure on the drawer face for convenient opening. The recessed drawer design is individually disclosed.

BACKGROUND OF THE INVENTION

It has long been desired to place drawers under box spring and mattress units in the bedroom. However, since the standard dimension available between the bottom of the box spring and the floor surface on which the bed rests is generally only 7 inches, previous attempts at such drawer placement have met with at least some of the following difficulties.

First, the disclosed cabinet must generally replace a metal bed frame. It must have generally the same height and dimension and yet allow for maximum storage capacity.

Second, the prior art has included so-called "face frames"—a decorated pre-finished front from which the drawers move to and from a closed position. Such face frames not only cause the drawer fronts to protrude into the spatial interval under the bed, but additionally are expensive. Such face frames when used with under bed drawers of the prior art have resulted in expensive and impractical designs.

Third, drawers have made relatively inefficient use of the space under beds. Usually, drawers are shallow—on the order of four inches—and in the closed disposition protrude from under the bed. Commonly, such drawers utilize so-called center slides—which center slides protrude into and occupy the depth interval of the drawer that would otherwise be available. Further, many units containing drawers raise the bed to which they are attached. When this occurs, such changes in dimension from standard are readily apparent.

Fourth, it has not been generally possible to include in a single stock keeping unit such a drawer organizer device which can fit double beds, queen sized beds, and king sized beds. As the proliferation of "double" bed sizes has occurred, it is not practical to have separate stock keeping units for each size bed. The result has been that such under bed drawer units are not available.

Some of us have vended a below bed mounted drawer set that generally solves the above problems more than one year before the above Priority Application was filed. However, this unit was not successful in the market place. Specifically, in order for the drawers to be opened, it was required that the user bend to the floor, hook his finger under the lower front edge of the drawer, and pull the drawer to the open position. It was only upon trial in the field that we have discovered two factors.

First, it is not advisable to have hardware in such a location. Any kind of normal drawer opening hardware mounted under a mattress constitutes an unreasonable obstruction.

Second, users will not stoop to floor level for the opening of such drawers. While access from the top of such drawers was acceptable, stooping to open such drawers was not. In a surprising number of cases, users sit on such beds and access the drawer contents. This being the case, another simple way of effecting drawer opening had to be found.

What has resulted is a drawer construction that is not only useful under a mattress but has additional utility in cabinets of conventional construction.

SUMMARY OF THE INVENTION

A prior art single stock keeping unit for accommodating double, queen, and king sized beds with both support and under the bed drawers is equipped with foot actuated drawer opening. Each stock keeping unit includes faced box spring supporting paired face frame-less cabinets which are conveniently shipped stacked one upon another and are placed back to back when assembled for underlying box spring support. Each face frame-less cabinet includes two floor-contacting members, two box spring contacting members, and three vertical members including a head vertical member, a foot vertical member, and an intermediate vertical member. Conventional drawers on side mounted drawer roller bearing and slide guides to expose a finished drawer front without hardware for opening and closing. The floor contacting member adjacent the drawer front is recessed relative to the drawer front to permit relatively small retracting movement of the drawer on side mounted drawer roller bearing and slide guides, the slide having a recessed portion for holding the drawer in the closed position. A drawer construction with a detent-actuated spring is mounted between the drawer back and frame from which the drawer is supported. When the drawer is initially closed, the detent retracts and the side mounted drawer roller bearing and slide guides move to a recessed portion of the slides, maintaining the drawer closed. When opening is desired, further inward pushing against the detent mechanism causes detent expansion, the drawer supporting rollers are urged out of engagement to the slide recess, and opening occurs. An under bed mounted drawer is disclosed which may be easily opened from the reclining, sitting, and/or standing position.

DESCRIPTION OF THE SPECIFIC EMBODIMENTS

Figure 1:
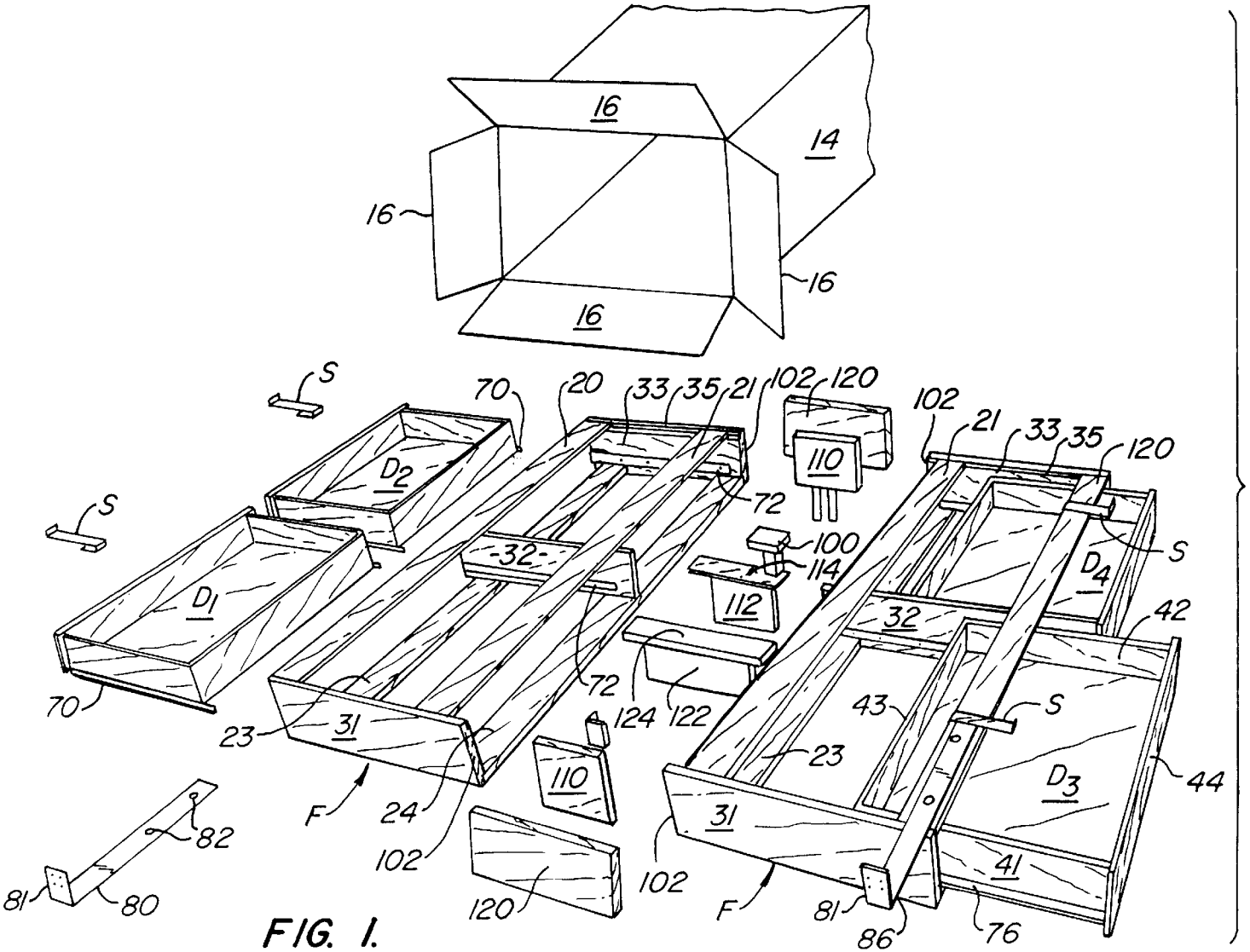
FIG. 1 is an exploded view with an emptied box formerly containing the unit as a single stock keep item with the cabinet and drawers being removed illustrating face frameless cabinets with spacers for fastening the units in double bed spacing, queen size bed spacing and king size bed spacing all being illustrated.

Referring to FIG. 1, box 14 is shown opened a conventional box flaps 16. From box 14 paired face frameless units F have been withdrawn. These paired face frameless units F are shown arrayed on the floor for the convenience of the reader.

The so-called "face frameless" units can now be described.

Each face frameless unit F includes outer box spring contacting member 20 and inner box spring contacting member 21.

Further, each face frameless unit F has outside floor contacting member 23 and inside floor contacting member 24. As will be emphasized later, the manner in which outside floor contacting member 23 is set back with respect to the respective edge of face frameless unit F enables convenient opening of the drawers without the requirement for drawer hardware.

Each face frameless cabinet further includes head exterior member 31, foot exterior member 33, with medial member 32 therebetween. As can be seen, head exterior member 31 and foot exterior member 33 are routed along the top and bottom edge with rabbited grooves 35. Rabbited groove 35 captures each of outer box spring contacting member 20, inner box spring contacting member 21, outside floor contacting member 23, and inside floor contacting member 24 to assure right angle fastening of the respective members to one another. This enables conceal fastening of exterior members 31, 33 without protruding fasteners marring appearance of the unit.

Assembly of the respective paired face frameless unit F is easy to understand. The respective ends of outer box spring contacting member 20, inner box spring contacting member 21, outside floor contacting member 23, and inside floor contacting member 24 are each captured within the respective rabbited grooves 35 of head exterior member 31 and foot exterior member 33. Further, medial member 32 is fastened parallel to and intermediate of the respective head exterior member 31 and foot exterior member 33.

Drawers D1–D4 are conventional in construction and easy to understand. Each drawer includes drawer bottom 40. Drawer sides 41–42, drawer back 43, and drawer front 44 are conventionally routed on the inside of each of drawers D1–D4 to capture the respective drawer bottoms 40.

Figure 3:
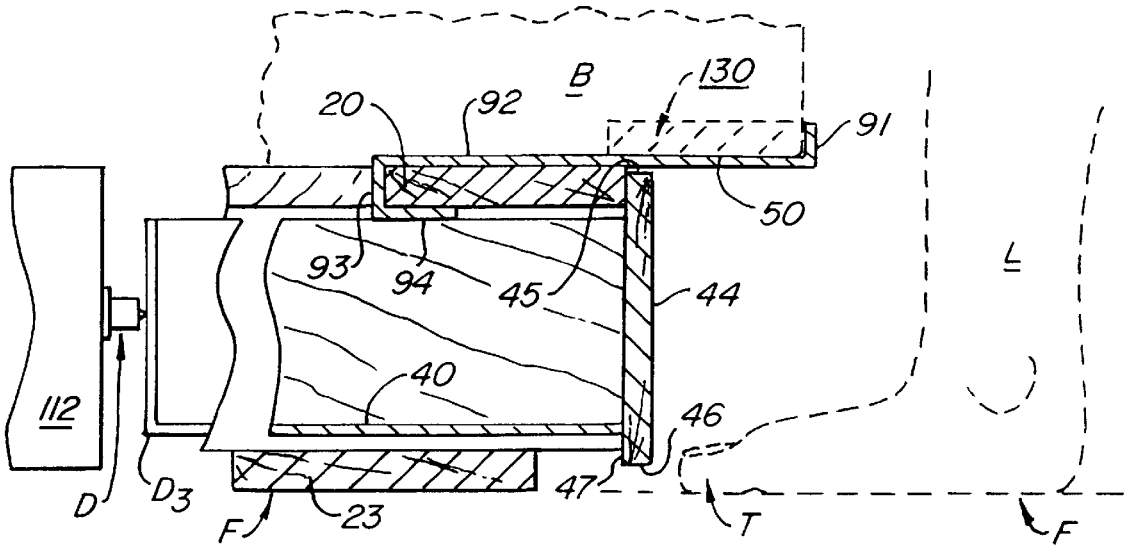
FIG. 3 is a side elevation detail of a box spring centering brackets illustrating centering of the box spring relative to upper box spring supporting member to define a space between the centered box spring and an underlying drawer in the closed position; and, FIG. 4 is a second side elevation detail similar to FIG. 3 illustrating a closed drawer front and further illustrating the drawer being kicked by a foot to actuate the detent mechanism; and, FIG. 5 is a schematic illustrating the cooperation between the detent and the drawer guide to open the drawer responsive to the kick illustrated in FIG. 4.
Figure 4:
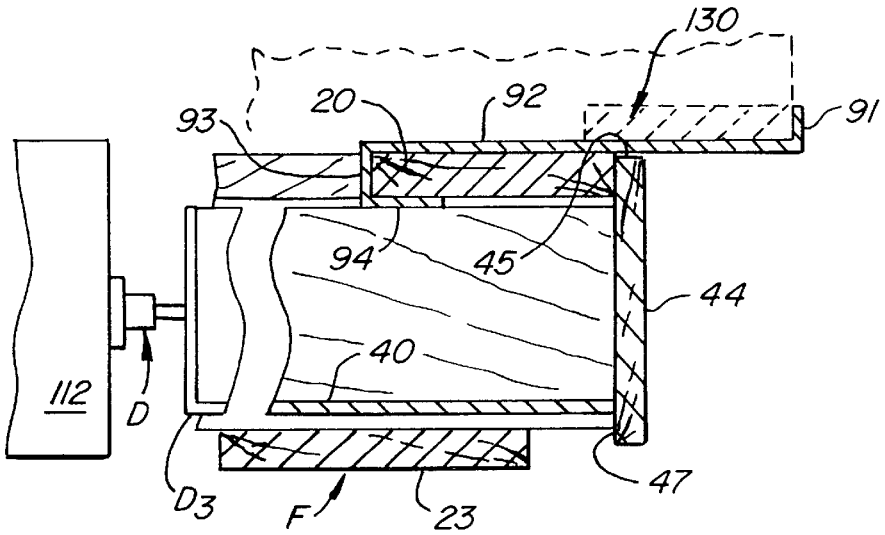

With respect to FIGS. 3 and 4, several important features of drawer front 44 should be noted. First, drawer front 44 at top edge 45 is set below lower edge 50 of box spring B a sufficient distance to provide convenient clearance. Second, lower edge 46 is raised above relative to supporting floor F a sufficient interval to permit finger tip 60 of hand H to reach under and behind drawer front 44. With such a reach, each drawer D is opened by grasping drawer front 44 at back bottom drawer front side 47. This dimension is chosen so that virtually all thicknesses of carpet reasonably anticipated within the bedroom environment can be accommodated. Third, no hardware is required on drawer front 44; the drawer D in the closed position presents a continuous neutral, concealed appearance. Fourth, respective drawer fronts 44 of drawers D1–D4 in the closed position in paired face frameless unit F form a continuous and uninterrupted side to the box spring B and mattress M supporting unit of this invention.

Once paired face frameless units F are assembled, mounting of respective drawers D1–D4 is easy to understand. Specifically, side and bottom mounted drawer guides 70 on respective drawers D1–D4 at drawer sides 41–42 mate with member mounted drawer guides 72. Member mounted drawer guides 72 are each installed on the inside lower edge of head exterior member 31 (one guide on inside), medial member 32 (two guides on either side), and foot exterior member 33 (one guide on inside).

It is necessary that box spring B be held in fixed relationship relative to underlying paired face frameless unit F. To this end there is provided head brackets 80 and side brackets S. Head brackets 80 are conventional and optional; they are provided with standard head board connection apertures 81 and can fasten at fastening apertures 82 to respective outer box spring contacting member 20.

Side brackets S are separately illustrated in FIG. 3 or 4 and unique to the disclosure herein. These respective side brackets S include box spring capturing lip 91, side spacer member 92, and hook members 93–94. As will hereafter be emphasized, hook members 93–94 grip the inside edge of outer box spring contacting member 20. Side spacer member 92 is given a length so that box spring B can be precisely positioned relative to outer box spring contacting member 20. Finally, fastening apertures 96 are provided so side brackets S once initially positioned can be maintained in place by conventional screws—not shown. Other conventional bracket location features can be used.

Returning again to FIG. 1, it will be remembered that a single stock keeping unit contained within box 14 must accommodate three bed sizes; these bed sizes are double bed size (54×80 inches), queen bed size (60×80 inches), and king bed size (72×84 or 78×80). This being the case, it is necessary that paired face frameless units F be fastened in varying side-by-side spatial relationship.

For making a double bed connection between paired face frameless unit F, the respective units are abutted at female routed grooved edges 102. Thereafter, double bed fastener 100 fastens as a connecting plate over the respective medial members 32 of paired face frameless unit F. With this member in place, double bed spacing is maintained.

For making a queen bed connection between paired face frameless unit F, male grooved side spacers 110 fit respectively between head exterior member 31 and foot exterior member 33 at female routed grooved edges 102. Between the respective medial members 32 of paired face frameless unit F, male grooved central spacer 112 with side extending cap 114 is utilized. By the expedient of fastening side extending cap 114 to the top of the respective medial members 32 of paired face frameless unit F, queen size spacing can be maintained between the respective paired face frameless cabinets.

For making a king bed connection between paired face frameless unit F, king male grooved side spacers 120 fit respectively between head exterior member 31 and foot exterior member 33 at female routed grooved edges 102. Between the respective medial members 32 of paired face frameless unit F, king male grooved central spacer 122 with side extending cap 124 is utilized. By the expedient of fastening side extending cap 124 to the respective medial members 32 of paired face frameless unit F, king size spacing can be maintained between the respective paired face frameless cabinets.

It will be understood that support of box spring B occurs in several ways. First, outer box spring contacting member 20 support box spring B at the side edges, specifically at side box spring members 130 (See FIG. 3). Finally, double bed fastener 100, side extending cap 114 for queen sized beds, or side extending cap 124 for king sized beds support the particular box spring B at the center portion thereof. It has been found that this array of supports suits virtually all conventional mattresses now on the market.

It will further be noted that certain soft sided water beds are suitable for use with this invention. In these beds, a box spring and mattress like structure contains a water inflatable membrane.

Figure 2:
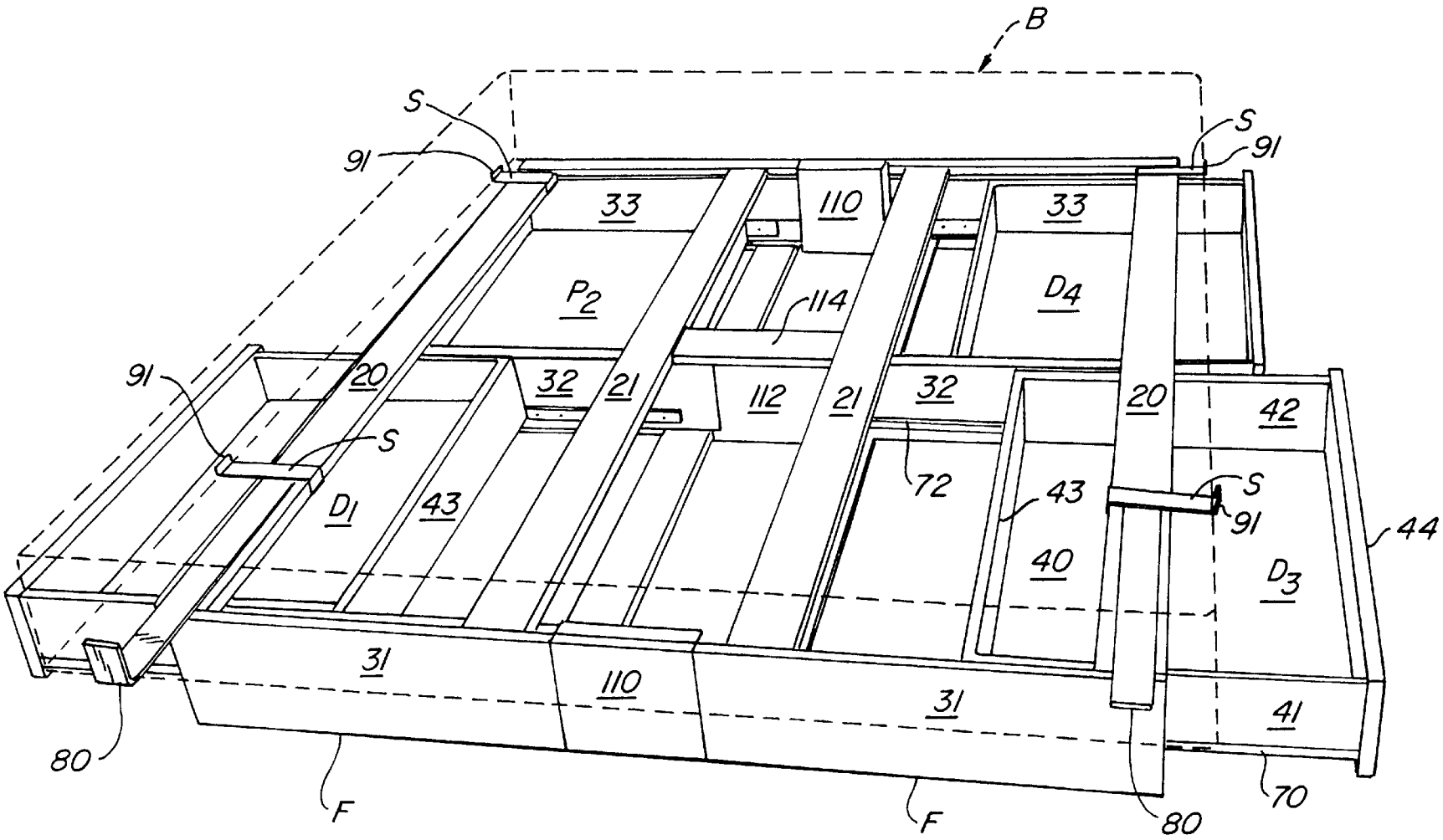
FIG. 2 illustrates the face frameless cabinet assembled back to back in double bed spacing with their respective drawers in the open position and spacers for queen size spacing shown joining the assembled units.

Having set forth the respective members of the single stock keeping unit packaged within box 14, attention can now be directed to the support of box spring B of a queen size bed as illustrated in FIG. 2.

Referring to FIG. 2, respective paired face frameless unit F have been placed in back-to-back relationship with spacing slightly exceeding that required for double bed placement. At respective head exterior member 31 and foot exterior member 33, respective male grooved side spacers 110 have been added. Finally, and before placement of box spring B, male grooved central spacer 112 has been placed between medial members 32. It will be observed that side extending cap 114 of male grooved central spacer 112 extends over medial member 32 of paired face frameless unit F at one end and over medial member 32 of paired face frameless unit F at the opposite end. By the expedient of fastening this member with a wood set screw (not shown), the respective paired face frameless cabinet units are now fastened in queen size bed spacing ready to receive the box spring B of such a unit.

The spacing that results need simultaneous reference to the views of FIGS. 2 and 3 for complete understanding. To understand this spacing, reference will first be made to the standard construction of box springs. Second, the spacing of the respective outer box spring contacting members 20 as set forth in the queen size bed spacing illustrated in FIG. 2 will be discussed. Finally, these respective dimensional relationships will thereafter be shown to enable the space relationship of drawer front 44 of drawers D1–D4 in the closed position as illustrated with respect to FIG. 3.

Regarding standard box spring construction, the side elevation section of FIG. 3 is sufficient to explain such construction. Specifically, box springs B include side box spring members 130. Side box spring members 130 have a side width of 2-½ inches. Simply stated, when paired face frameless unit F are fastened in queen size bed relationship, the respective outer box spring contacting member 20 are dimensioned in parallel spaced apart relation to capture approximate ¾ to 1-½ inches of these respective outer box spring contacting member 20 along their entire length. This capture occurs at the inside edge of side box spring members 130 to the outside edge of outer box spring contacting member 20. This respective edge support causes box spring B at side box spring members 130 to cantilever over drawer front 44 when respective drawers D1–D4 are in the closed position. This has been found to provide more than sufficient support for the side edges of box spring B.

Naturally, it is required that box spring B be maintained precisely centered with respect to paired face frameless unit F when they are held in queen size bed spacing. Accordingly, side brackets S at hook members 93–94 capture the inside edge of outer box spring contacting member 20. This spaces box spring capturing lip 91 to capture side box spring members 130 of box spring B.

Further, and most importantly, it will be seen that box spring B at side box spring members 130 hangs over drawer front 44 when drawers D1–D4 are in the closed position. As can plainly be seen in FIG. 3, toes T of foot 140 enable a person making the bed to stand into the bed almost as if a conventional bed supporting frame were utilized.

Secondly, and with respect to FIG. 4, opening of the respective drawers D1–D4 can now be set forth. First, it will be remembered that outside floor contacting member 23 is set in with respect to the outside edges of face frameless unit F. This leave a spatial interval between back bottom drawer front side 47 of drawer front 44 and outside floor contacting member 23.

Figure 5:
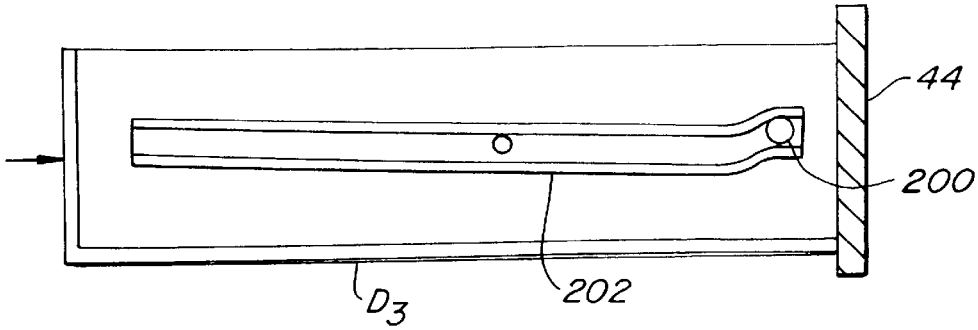

Operation of the drawer device can be easily understood from the section of FIG. 4 and the schematic of FIG. 5. Specifically, and referring to FIG. 4, leg L gently kicks drawer front 44. This slightly compress detent device D against male grooved central spacer 112. Detent device D is a standard item of manufacture made by Bainbridge Manufacturing, Inc of Bainbridge, Wash. and sold under the designation Flexa Touch Open. With slight compression, this detent device D expands as shown in FIG. 5. With a second compression, this detent device D contracts. Repeated cycles alter the spring loaded device from the compressed state to the expanded state.

In FIG. 5, the effect of such expansion is illustrated. Specifically, detent device D upon slight compression expands under released compression from a coil spring. Expansion is against male grooved central spacer 112 and the back of drawer $D_3$. Drawer $D_3$ moves slightly outward.

Attention now can be devoted to side mounted drawer roller bearing and slide guides G illustrated in FIG. 5 at guide 202 and roller 200. I will be seen that guide 202 lowers drawer $D_3$ slightly when in the closed position. When drawer $D_3$ is slightly urged open by detent device D, roller 200 moves to the level portion of guide 202. Guide 202 is very slightly sloped so that drawer $D_3$ at least slightly opens.

It has been found that this convenience of opening is critical in the sale of this product. Further, since the absence of hardware is required, this mechanism is highly desirable.

It will be understood that the drawer here shown can be mounted in virtually any cabinet. While it is preferred to place the cabinet in the mattress supporting position here utilized, other cabinet configurations will suffice.

What is claimed is:

1. In the combination of a rectilinear mattress having a head, a foot and two longitudinally extending side edges; a box spring for supporting the mattress, the box spring having paired side edge bottom members of a standard width; and a drawer organizer for supporting the box spring and overlying mattress, the improvement to the drawer organizer comprising:

paired face frameless cabinets, each cabinet including, a head partition member;

a foot partition member;

at least one medial partition member;

a bed side edge box spring supporting member extending parallel to the longitudinally extending sides edges of the mattress for fastening to an upper side of the head partition member, the foot partition member, and the at least one medial partition member;

at least four drawers each including a drawer front for sliding opening and closing movement to a closed position relative to the side edge box spring supporting members, said drawers being between the partition members with the drawer front of the drawers in the closed position defining the face to the cabinet in the closed position proximate to the bed side edge box spring supporting member;

means for fastening the face frameless cabinets in variable spacing from a group including double bed size spacing, queen bed size spacing and king bed size spacing with the bed side edge box spring supporting member at an edge adjacent the bed side edge supporting only of one of the paired side edge bottom members of the box spring to cantilever out the box spring relative to the drawer front; and, means for centering the box spring relative to the paired side edge bottom members in cantilevered relation whereby the box spring and the drawer front defines respectively an edge and an underlying recessed plate;

means for mounting the drawers on side mounted drawer roller bearing and slide guides having a change in drawer guide elevation to maintain the drawer normally closed; and, detent means having a first compressed state to permit the drawer to remain normally closed and a second expanded state to permit the drawer to be normally open whereby upon inward movement of the drawer against the detent device, movement of the drawer between the normally closed and open disposition occurs.

2. In the combination of cabinet for supporting a drawer; and a drawer for support to the cabinet, the improvement to the drawer comprising:

a cabinet for receiving a drawer;

means for mounting the drawer on side mounted drawer roller bearings and slide guides having a first portion defining a region of a change in drawer elevation relative to the side mounted drawer roller bearings and slide guide when the drawer is in a closed disposition to maintain the drawer normally closed;

the slide guide having a second portion sloped to permit said drawer to move to an open disposition under gravitational bias when said drawer moves beyond the first portion to a sloped second portion; and, detent means having a first compressed state to permit the drawer to remain normally closed with the roller in the first portion and a second expanded state to permit the drawer to be normally open with the roller in the second portion whereby upon inward movement of the drawer against the detent device, movement of the drawer between the normally closed and open disposition occurs.

* * * * *